US010762825B2

(12) United States Patent
Kim et al.

(10) Patent No.: US 10,762,825 B2
(45) Date of Patent: Sep. 1, 2020

(54) GAMMA CORRECTION CIRCUIT AND GAMMA CORRECTION METHOD

(71) Applicant: DB HiTek Co., Ltd., Seoul (KR)

(72) Inventors: Kyoung-Tae Kim, Seoul (KR); Seung-Jin Yeo, Anyang-si (KR); Mun-Gyu Kim, Seoul (KR); Jae-Hong Ko, Seoul (KR)

(73) Assignee: DB HiTek Co., Ltd., Seoul (KR)

( * ) Notice: Subject to any disclaimer, the term of this patent is extended or adjusted under 35 U.S.C. 154(b) by 75 days.

(21) Appl. No.: 16/234,313

(22) Filed: Dec. 27, 2018

(65) Prior Publication Data

US 2020/0020268 A1 Jan. 16, 2020

(30) Foreign Application Priority Data

Jul. 10, 2018 (KR) ..... 10-2018-0079890

(51) Int. Cl.
*G09G 3/20* (2006.01)
*G09G 3/3208* (2016.01)
*G09G 3/36* (2006.01)

(52) U.S. Cl.
CPC ..... *G09G 3/2007* (2013.01); *G09G 3/2003* (2013.01); *G09G 3/3208* (2013.01); (Continued)

(58) Field of Classification Search
USPC ..... 345/690
See application file for complete search history.

(56) References Cited

U.S. PATENT DOCUMENTS

2005/0007393 A1* 1/2005 Akai ..... G09G 3/3291 345/690
2005/0012700 A1* 1/2005 Hara ..... G09G 3/3688 345/89

(Continued)

FOREIGN PATENT DOCUMENTS

KR 10-0306644 A 8/2001

OTHER PUBLICATIONS

Hyo-Seung Lee; "Gamma Correction Device of Digital Video Data and Gamma Correction Method"; Abstract of KR100306644; Registration Date Aug. 11, 2001; 2 pgs.; http://engpat.kipris.or.kr.

*Primary Examiner* — Chineyere D Wills-Burns
(74) *Attorney, Agent, or Firm* — Andrew D. Fortney; Central California IP Group, P.C.

(57) ABSTRACT

Disclosed is a gamma correction circuit and method capable of minimizing power consumption by adding third and fourth input amplifiers receiving reference voltages which are identical to voltages to first and second input amplifiers, respectively, and deactivating the first and second input amplifiers during an always on display (AOD) mode. The gamma correction circuit includes a first input amplifier configured to output a maximum voltage when active, a second input amplifier configured to output a minimum voltage when active, a third input amplifier configured to output a highest gamma voltage in response to the first reference voltage, and a fourth input amplifier configured to output a lowest gamma voltage in response to the second reference voltage. The first and second input amplifiers are deactivated when the display driving device operates in the AOD mode.

20 Claims, 5 Drawing Sheets

(52) U.S. Cl.
CPC ..... *G09G 2310/0291* (2013.01); *G09G 2320/0276* (2013.01); *G09G 2320/0673* (2013.01); *G09G 2330/021* (2013.01); *G09G 2330/028* (2013.01)

(56) References Cited

U.S. PATENT DOCUMENTS

| | | | | |
|---|---|---|---|---|
| 2007/0146395 | A1* | 6/2007 | Lee | G09G 3/2007 345/690 |
| 2008/0259013 | A1* | 10/2008 | Kobayashi | G09G 3/20 345/89 |
| 2009/0213042 | A1* | 8/2009 | Hagino | G09G 3/3696 345/55 |
| 2011/0141098 | A1* | 6/2011 | Yaguma | G09G 3/3688 345/212 |
| 2011/0175943 | A1* | 7/2011 | Ahn | G09G 3/20 345/690 |
| 2016/0118000 | A1* | 4/2016 | Kim | G09G 3/3688 345/691 |
| 2018/0268780 | A1* | 9/2018 | Bae | G09G 3/2003 |
| 2019/0295490 | A1* | 9/2019 | Kim | G09G 3/20 |

* cited by examiner

GAMMA CORRECTION CIRCUIT AND GAMMA CORRECTION METHOD

CROSS REFERENCE TO RELATED APPLICATION

The present application claims priority to Korean Patent Application No. 10-2018-0079890, filed Jul. 10, 2018, the entire contents of which are incorporated herein for all purposes by this reference.

BACKGROUND OF THE INVENTION

Field of the Invention

The present invention relates generally to a gamma correction circuit and a gamma correction method applied to display driving elements of a display device including an organic light emitting diode. More particularly, the gamma correction circuit and the gamma correction method are configured to minimize power consumption of the display device in an always on display (AOD) eight-color mode.

Description of the Related Art

In a conventional display device, distortion may occur between an input image data and an output image. In other words, the display device may not represent a linear relation between the image data and the image, and thus distortion may occur between the image data and the output image.

Accordingly, the display device outputs an optimized image by performing distortion compensation using a gamma curve.

However, each display device may have a panel type, so that a different gamma curve may be required for each display device. In other words, although different display devices receive the same image data, a different gamma curve with a maximum value, a minimum value, and a slope depending on the panel type may be applied to each display device.

Accordingly, in the display, a gamma correction circuit configured to provide various gamma curves is integrated to provide the gamma curve. However, the voltage range controlled by conventional gamma correction circuit may be limited or restricted, and to expand the voltage range to be controlled, a large size chip is required.

Accordingly, there is a need for a gamma correction circuit that minimizes chip area and is capable of providing various gamma curves. In addition, since a display device for a mobile terminal has limited usable power, a gamma correction circuit that minimizes power consumption is also desired.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and an object of the present invention is to provide a gamma correction circuit and a gamma correction method having a third input amplifier and a fourth input amplifier that receive reference voltages identical to voltage inputs to a first input amplifier and a second input amplifier, wherein power consumption is minimized by deactivating the first input amplifier and the second input amplifier in an AOD mode.

To achieve the above-mentioned object, the present invention may be implemented by the following embodiments.

According to one or more embodiments of the present invention, a gamma correction circuit, including a first input amplifier configured to output a maximum voltage when receiving a first reference voltage, a second input amplifier configured to output a minimum voltage when receiving a second reference voltage, a third input amplifier configured to output a highest gamma voltage when receiving the first reference voltage wherein and the first and third input amplifiers share a first input terminal, and a fourth input amplifier configured to output a lowest gamma voltage when receiving the second reference voltage wherein the second and fourth input amplifiers share a second input terminal. The first input amplifier and the second input amplifier are deactivated when the display driving device operates in an AOD mode.

The gamma correction circuit according to one or more embodiments of the present invention may further include a first resistor column configured to receive the maximum voltage from the first input amplifier and the minimum voltage from second input amplifier, wherein the first resistor column may distribute the maximum voltage and the minimum voltage. The circuit may further include a decoder configured to output one of the voltages distributed by the first resistor column.

An output amplifier (e.g., of the gamma correction circuit) may include a first output amplifier to a fifth output amplifier, wherein the first output amplifier to the fifth output amplifier may output gamma voltages that (i) exceed or are higher than the lowest gamma voltage, (ii) are less than the highest gamma voltage, and (iii) differ from each other. The output amplifier may be deactivated when the display driving device operates in an AOD mode.

The gamma correction circuit according to one or more embodiments of the present invention may further include a second resistor column configured to receive one of the gamma voltages from the output amplifier. The second resistor column may generate grayscale voltages on the basis of the gamma voltage.

Meanwhile, the first input amplifier may not output the maximum voltage when the first input amplifier is deactivated, and the second input amplifier may not output the minimum voltage when the second input amplifier is deactivated. The maximum voltage and the highest gamma voltage may be the same, and the minimum voltage and the lowest gamma voltage may be the same.

In order to achieve the above-mentioned object, a gamma correction circuit according to other embodiments of the present invention may be provided. The circuit includes a first input amplifier and a third input amplifier configured to receive a first reference voltage, a second input amplifier and a fourth input amplifier configured to receive a second reference voltage, a first resistor column configured to receive and distribute voltages from the first input amplifier and the second input amplifier, a decoder configured to output one or more of the voltages distributed by the first resistor column, a plurality of output amplifiers configured to receive the one or more voltages from the decoder and output voltages that exceed or are higher than a voltage from the fourth input amplifier and are less than a voltage from the third input amplifier, and a second resistor column configured to generate grayscale voltages based on or in response to the voltages from the plurality of output amplifiers. The first input amplifier the second input amplifier, and the plurality of output amplifiers are deactivated when the display driving device operates in an always on display (AOD) mode.

The first input amplifier may output a maximum voltage to the first resistor column and the second resistor column when the first input amplifier is active, and the second input amplifier may output a minimum voltage to the first resistor column and the second resistor column when the second input amplifier is active.

The third input amplifier may output a highest gamma voltage when the first reference voltage is input, and the fourth input amplifier may output a lowest gamma voltage when the second reference voltage is input.

The plurality of output amplifiers may include a first output amplifier to a fifth output amplifier, and the first output amplifier to the fifth output amplifier may output gamma voltages that exceed or are higher than a voltage from the fourth input amplifier and are less than the voltage from the third input amplifier. The first output amplifier to the fifth output amplifier may output gamma voltages that are different from each other.

To achieve the above-mentioned object, a gamma correction method according to one or more embodiments of the present invention may include providing a gamma voltage to a display driving device from a gamma correction circuit. The method includes deactivating a first input amplifier and a second input amplifier of the gamma correction circuit when the display driving device operates in an always on display (AOD) mode, deactivating a first output amplifier to a fifth output amplifier of the gamma correction circuit when the display driving device operates in the AOD mode, and outputting a highest gamma voltage and a lowest gamma voltage from the third input amplifier and a fourth input amplifier of the gamma correction circuit when the driving device operates in the AOD mode.

Outputting the highest gamma voltage and the lowest gamma voltage may include outputting the highest gamma voltage from the third input amplifier when a first reference voltage is input, and outputting the lowest gamma voltage from the fourth input amplifier when a second reference voltage is input.

When the display driving device operates in a mode other than an AOD mode, the method may further include activating the first input amplifier, the second input amplifier, and the first output amplifier to the fifth output amplifier.

The gamma correction method according to one or more embodiments of the present invention may further include outputting a maximum voltage from the first input amplifier, and outputting a minimum voltage from the second input amplifier.

The maximum voltage and the highest gamma voltage may be the same, and the minimum voltage and the lowest gamma voltage may be the same.

In various embodiments, the maximum voltage may be output to a first resistor column and a second resistor column, and the minimum voltage may be output to the first resistor column and the second resistor column.

The gamma correction method according to one or more embodiments of the present invention may further include distributing, in response to the maximum voltage, and the minimum voltage and outputting a plurality of distributed voltages the same from the first resistor column, and outputting one of the distributed voltages from a decoder.

The gamma correction method according to one or more embodiments of the present invention may further include receiving the one distributed voltage from the decoder by a plurality of output amplifiers, and outputting from the plurality of output amplifiers, the gamma voltages that exceed or are higher than the lowest gamma voltage and are less than the highest gamma voltage, and gamma voltages differ from each other.

The gamma correction method according to one or more embodiments of the present invention may further include generating grayscale voltages in the second resistor column, based on or in response to the gamma voltages from the plurality of output amplifiers, and outputting the grayscale voltages from the second resistor column (e.g., from or to a decoder of the display driving device).

The present invention may have the following effects with the above-described configuration(s).

According to various embodiments of the present invention, when a display driving device operates in an AOD mode, the gamma correction circuit and the gamma correction method deactivate a first input amplifier, a second input amplifier, and a first output amplifier to a fifth output amplifier, and output a highest gamma voltage and a lowest gamma voltage by activating a third input amplifier and a fourth input amplifier. Accordingly, wasting power due to (i) static current in the first and second input amplifiers and the first to fifth output amplifiers, and (ii) power consumption by the first and second resistor column currents, may be prevented.

In addition, the gamma correction circuit and the gamma correction method can minimize power consumption by additionally applying a third input amplifier and a fourth input amplifier, and thus a low power AOD mode can be realized while minimizing any increase in layout size compared to a conventional gamma correction circuit.

In addition, the gamma correction circuit and the gamma correction method increase static current compared to a conventional gamma correction circuit since an amplifier is added, but may realize a low power AOD mode by blocking current flow in the first resistor column and the second resistor column.

Further, in addition to the effects described above, effects that are apparent to those skilled in the art through the entire contents of the present specification should also be considered.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
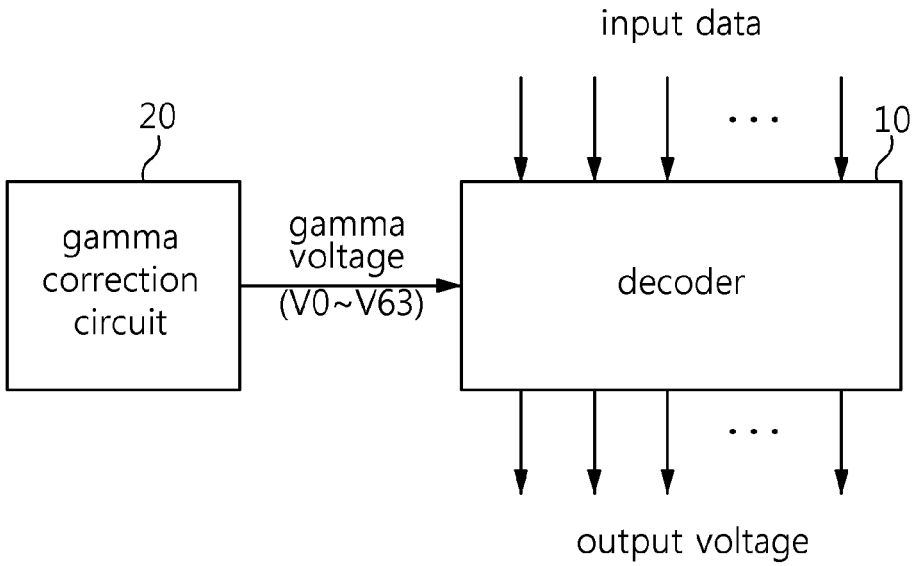
FIG. 1 is a view showing a conventional display driving device and gamma correction circuit.

Hereinafter, embodiments of the present invention will be described in detail with reference to the accompanying drawing so that those skilled in the art can easily carry out the technical ideas of the present invention. In the following description, like reference numerals designate like elements, although the like elements may be shown in different drawings. Further, in the following description of embodiments of the present invention, a detailed description of known functions and configurations may be omitted for the purpose of clarity and for brevity.

Figure 2:
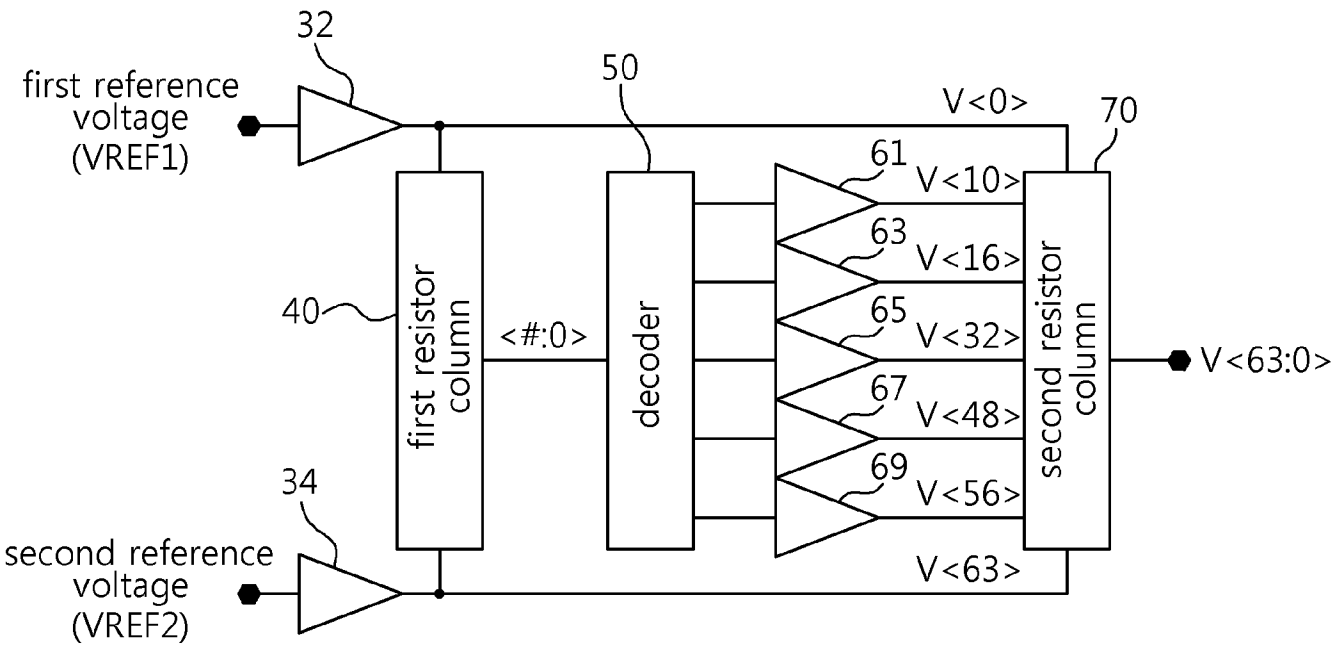
FIGS. 2 and 3 are views showing a conventional gamma correction circuit.
Figure 3:
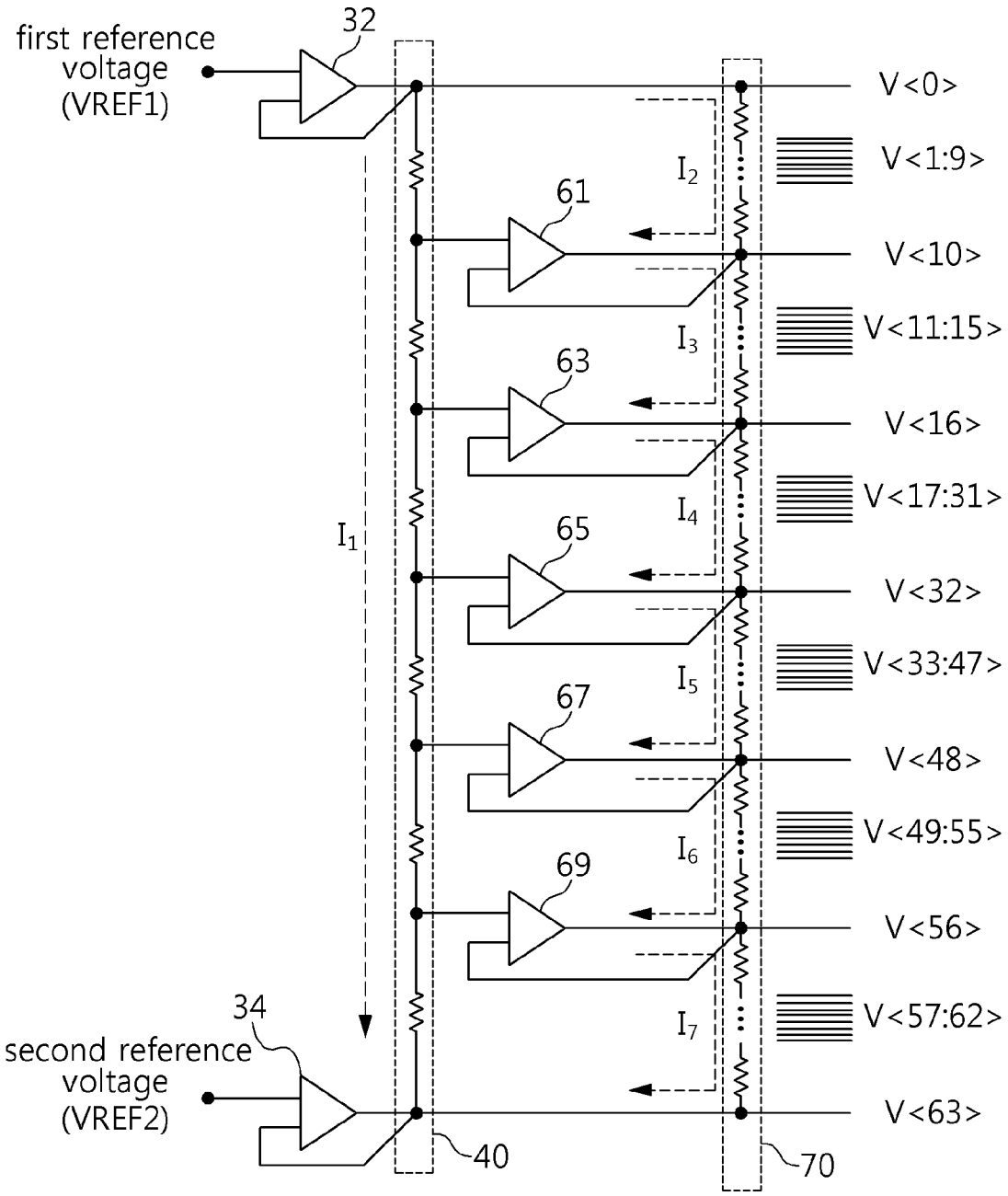

Hereinafter, a conventional display driving device and a conventional gamma correction circuit will be described in detail with reference to FIGS. 1-3. FIG. 1 is a view showing a conventional display driving device and gamma correction circuit, and FIGS. 2 and 3 are views showing a conventional gamma correction circuit.

Referring to FIG. 1, a conventional display driving device to which a gamma correction circuit 20 is applied includes a decoder 10.

The decoder 10 receives a gamma voltage (grayscale voltage) when input data is received. The decoder 10 may output an output voltage the input data is correct on the basis of the gamma voltage.

The decoder 10 receives one of 64 gamma voltages V0 to V63 when the input data has a width of 6 bits. Herein, the decoder 10 outputs another output voltage according to the received gamma voltage, even though the same input data is received.

As described above, the decoder 10 adjusts an output voltage using gamma voltage, and the display driving device may include a gamma correction circuit 20 that outputs a gamma voltage according to the panel type of the display.

Referring to FIG. 2, the conventional gamma correction circuit 20 of FIG. 1 includes a first input amplifier 32, a second input amplifier 34, a first resistor column 40, a decoder 50, a first output amplifier 61 to a fifth output amplifier 69, and a second resistor column 70.

The first input amplifier 32 outputs a highest gamma voltage V0 when a first reference voltage VREF1 is applied. The first input amplifier 32 outputs a maximum voltage to the first resistor column 40 and the second resistor column 70. Herein, the highest gamma voltage V0 means a voltage output as a gamma voltage, and the maximum voltage means a voltage applied to the first resistor column 40 and the second resistor column 70. Herein, the highest gamma voltage V0 and the maximum voltage are the same.

The second input amplifier 34 outputs a lowest gamma voltage V63 when a second reference voltage VREF2 is applied. The second input amplifier 34 outputs a minimum voltage to the first resistor column 40 and the second resistor column 70. Herein, the lowest gamma voltage V63 means a voltage output as a gamma voltage, and the minimum voltage means a voltage applied to the first resistor column 40 and the second resistor column 70. Herein, the lowest gamma voltage V63 and the minimum voltage are the same.

The first resistor column 40 distributes the maximum voltage and the minimum voltage from the first input amplifier 32 and the second input amplifier 34. Herein, when a desired voltage is set through the decoder 50, the decoder 50 applies a voltage selected from the voltages distributed from the first resistor column 40 to the first output amplifier 61 to the fifth output amplifier 69.

The first output amplifier 61 to the fifth output amplifier 69 respectively output gamma voltages within a range from the highest gamma voltage V0 to the lowest gamma voltage V63. Voltages from the first output amplifier 61 to the fifth output amplifier 69 are applied to the second resistor column 70. In one or more embodiments, the first output amplifier 61 outputs a first output voltage V10 that is lower than the highest gamma voltage V0. The second output amplifier 63 outputs a second output voltage V16 that is lower than the first output voltage V10. The third output amplifier 65 outputs a third output voltage V32 that is lower than the second output voltage V16. The fourth output amplifier 67 outputs a fourth output voltage V48 that is lower than the third output voltage V32. The fifth output amplifier 69 outputs a fifth output voltage V56 that is lower than the fourth output voltage V48 and higher than the lowest gamma voltage V63.

The second resistor column 70 generates grayscale voltages when the voltages from the first output amplifier 61 to the fifth output amplifier 69 are applied. Herein, the second resistor column 70 generates grayscale voltages on the basis of a tab-to-tab resistor ratio when the outputs of the first output amplifier 61 to the fifth output amplifier 69 are applied.

Referring to FIG. 3, power consumption of the gamma correction circuit 20 is determined by the amplifier static current (e.g., the gamma AMP static current), the current I1 of the first resistor column, and the current (e.g., I2+I3+I4+I5+I6+I7) of the second resistor column.

In other words, power consumption of the gamma correction circuit 20 may be reduced by decreasing the amplifier static current or increasing a resistor value of the resistor column since the dynamic range of the outputs (e.g., V<0>: V<63>) is pre-determined.

Accordingly, the above feature may become a factor for minimizing power consumption in an AOD eight-color mode in display driving elements (e.g., a display driver IC, or DDI) for an organic light emitting diode (OLED).

The AOD eight-color mode is a mode that the display device enters when a user finishes using the mobile terminal and/or completes using a work system. The display device continuously operates using the combination of the highest voltage and the lowest voltage of RGB colors in the AOD eight-color mode. Herein, the display has to minimize battery usage by minimizing power consumption when the user is not using the mobile device.

Accordingly, a conventional gamma correction circuit 20 deactivates an amplifier outputting a voltage excluding the highest gamma voltage and the lowest gamma voltage when the display device operates in an AOD eight-color mode. In other words, referring to FIG. 2, in the AOD eight-color mode, outputting only the highest gamma voltage and the lowest gamma voltage is required, and thus the gamma correction circuit 20 activates the first input amplifier 32 and the second input amplifier 34, and deactivates the first output amplifier 61 to the fifth output amplifier 69.

Herein, power consumption of the gamma correction circuit 20 occurs by static current of the first input amplifier 32 and the second input amplifier 34, and by current flow in the first resistor column 40 and the second resistor column 70.

However, the conventional gamma correction circuit 20 has a structure where current flows in the first resistor column 40 and second resistor column 70 when the highest gamma voltage and the lowest gamma voltage are generated, and thus the circuit consumes power.

To solve the above problem, resistor values of the first resistor column 40 and the second resistor column 70 have to increase. However, the AC characteristics of the amplifiers in conventional gamma correction circuit 20 degrade when resistor values of the resistor column increase. In addition, the conventional gamma correction circuit 20 increases in size as the resistor values increase.

Hereinafter, an exemplary gamma correction circuit according to one or more embodiments of the present invention will be described in detail with reference to FIG.

Figure 4:
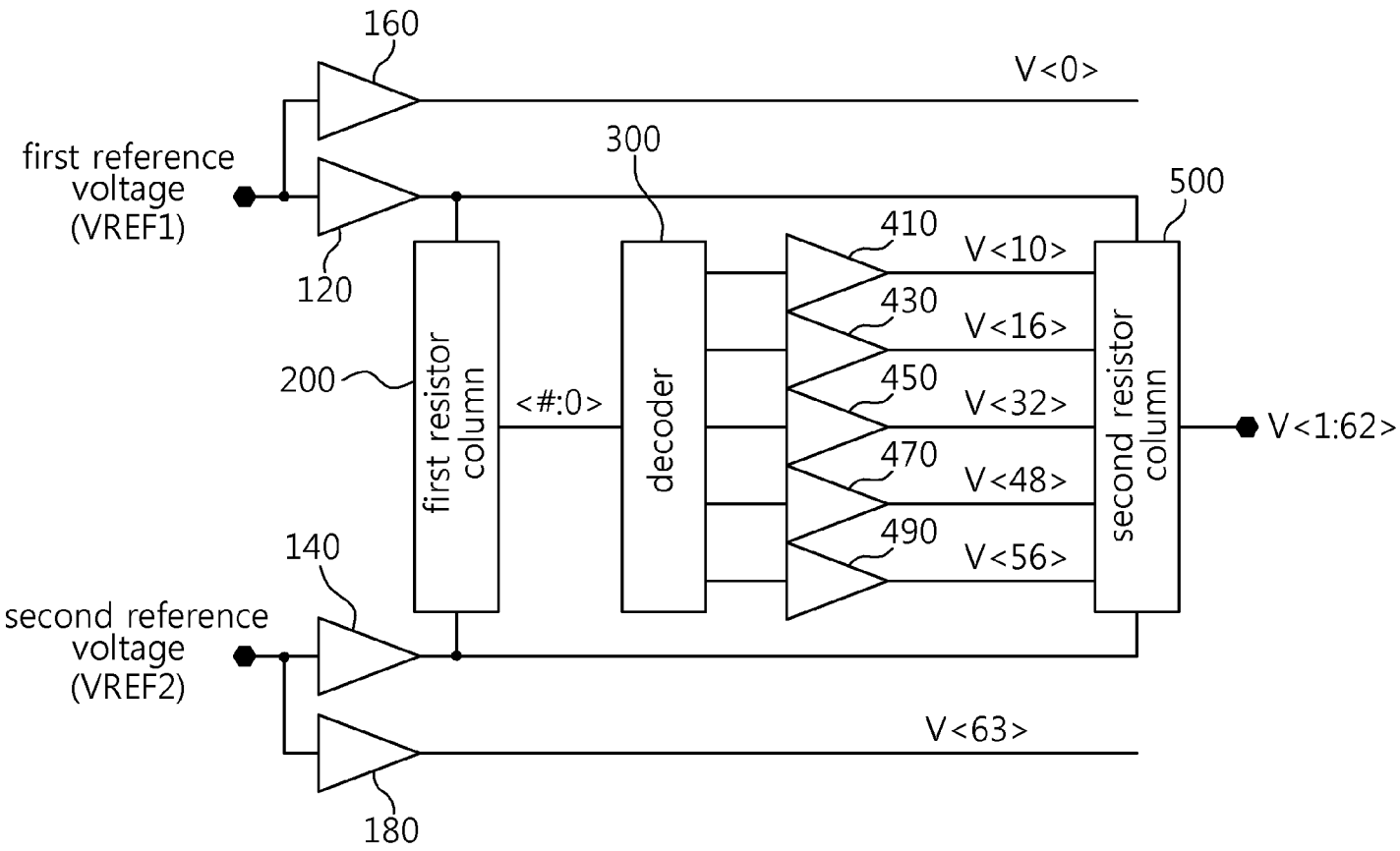
FIG. 4 is a view showing an exemplary gamma correction circuit according to one or more embodiments of the present invention.

4. FIG. 4 is a view showing an exemplary gamma correction circuit according to one or more embodiments of the present invention.

Referring to FIG. 4, a gamma correction circuit according to one or more embodiments of the present invention includes a first input amplifier 120, a second input amplifier 140, a third input amplifier 160, a fourth input amplifier 180, a first resistor column 200, a decoder 300, a first output amplifier 410 to a fifth output amplifier 490, and a second resistor column 500.

The first input amplifier 120 is activated when the display driving device operates in a mode other than an AOD mode. The first input amplifier 120 outputs a maximum voltage when active and a first reference voltage VREF1 is input. Herein, the first input amplifier 120 may output the maximum voltage to the first resistor column 200 and the second resistor column 500.

The first input amplifier 120 is deactivated when the display driving device operates in an AOD mode. Herein, static current is blocked since the first input amplifier 120 is deactivated during an AOD mode. The first input amplifier 120 does not output a voltage to the first resistor column 200 and the second resistor column 500 even though the first reference voltage VREF1 is input, since the first input amplifier 120 is deactivated.

The second input amplifier 140 is activated when the display driving device operates in a mode other than an AOD mode. The second input amplifier 140 outputs a minimum voltage when a second reference voltage VREF2 is input when active. Herein, the second input amplifier 140 outputs the minimum voltage to the first resistor column 200 and the second resistor column 500.

The second input amplifier 140 is deactivated when the display driving device operates in an AOD mode. Herein, static current is blocked since the second input amplifier 140 is deactivated during an AOD mode. The second input amplifier 140 does not output a voltage to the first resistor column 200 and the second resistor column 500, even though a second reference voltage VREF2 is input since the second input amplifier 140 is deactivated.

Similar to the first input amplifier 120, the third input amplifier 160 receives the first reference voltage VREF1. The third input amplifier 160 outputs a highest gamma voltage V0 when the first reference voltage VREF1 is input. The third input amplifier 160 maintains an active state, regardless of the operation mode of the display driving device. Herein, the highest gamma voltage V0 from the third input amplifier 160 is a voltage identical to the maximum voltage from the first input amplifier 120.

Similar to the second input amplifier 140, the fourth input amplifier 180 receives the second reference voltage VREF2. The fourth input amplifier 180 outputs a lowest gamma voltage V63 when the second reference voltage VREF2 is input. The fourth input amplifier 180 maintains an active state regardless of the operation mode of the display driving device. Herein, the lowest gamma voltage V63 from the fourth input amplifier 180 is a voltage identical to the minimum voltage from the second input amplifier 140.

In addition, output terminals of the third input amplifier 160 and the fourth input amplifier 180 are not electrically connected to the first resistor column 200 and the second resistor column 500 which will be described later, but input terminals of the third input amplifier 160 and the fourth input amplifier 180 are respectively shared with the first input amplifier 120 and the second input amplifier 140.

The first resistor column 200 distributes a plurality of voltages from the maximum voltage and the minimum voltage from the first input amplifier 120 and the second input amplifier 140. Herein, when a desired selection voltage is set through the decoder 300, the decoder 300 applies one or more of the distributed voltages from the first resistor column 200 to the first output amplifier 410 through the fifth output amplifier 490.

The first output amplifier 410 to the fifth output amplifier 490 respectively output gamma voltages that are less than the highest gamma voltage V0 and that exceed or are higher than the lowest gamma voltage V63. Voltages from the first output amplifier 410 to the fifth output amplifier 490 are applied to the second resistor column 500. In one embodiment, the first output amplifier 410 outputs a first output voltage V10 lower than the highest gamma voltage V0. The second output amplifier 430 outputs a second output voltage V16 lower than the first output voltage V10. The third output amplifier 450 outputs a third outputs voltage V32 lower than the second output voltage V16. The fourth output amplifier 470 outputs a fourth output voltage V48 lower than the third output voltage V32. The fifth output amplifier 490 outputs a fifth output voltage V56 lower than the fourth output voltage V48 and higher than the lowest gamma voltage V63.

The second resistor column 500 generates grayscale voltages when the voltages from the first output amplifier 410 to the fifth output amplifier are applied. Herein, the second resistor column 500 may generate grayscale voltages according to a tab-to-tab resistor ratio when the outputs of the first output amplifier 410 to the fifth output amplifier 490 are applied.

As described above, in the gamma correction circuit according to one or more embodiments of the present invention, different from the conventional gamma correction circuit, the third input amplifier 160 and the fourth input amplifier 180 are added, enabling one to remove the current flowing in the first resistor column 200 and the second resistor column 500 during an AOD eight-color mode.

The third input amplifier 160 and the fourth input amplifier 180 respectively share the first reference voltage VREF1 and the second reference voltage VREF2 with the first input amplifier 120 and the second input amplifier 140. When entering into an AOD eight-color mode, the first input amplifier 120 and the second input amplifier 140 are deactivated, and the third input amplifier 160 and the fourth input amplifier 180 are activated.

Accordingly, the third input amplifier 160 and the fourth input amplifier 180 respectively output the highest gamma voltage V0 and the lowest gamma voltage V63 in respect to the first reference voltage VREF1 and the second reference voltage VREF2. Herein, the first input amplifier 120 and the second input amplifier 140 switch to an inactive state so that current flow in the first resistor column 200 and the second resistor column 500 can be completely removed.

Meanwhile, in one or more embodiments of the present invention, the gamma correction circuit output a voltage from the lowest gamma voltage V0 to the highest gamma voltage V63, but it is not limited thereto. Gamma tabs may be changed to other values such as V255, V1023, etc., according to the resolution of the liquid crystal display.

Figure 5:
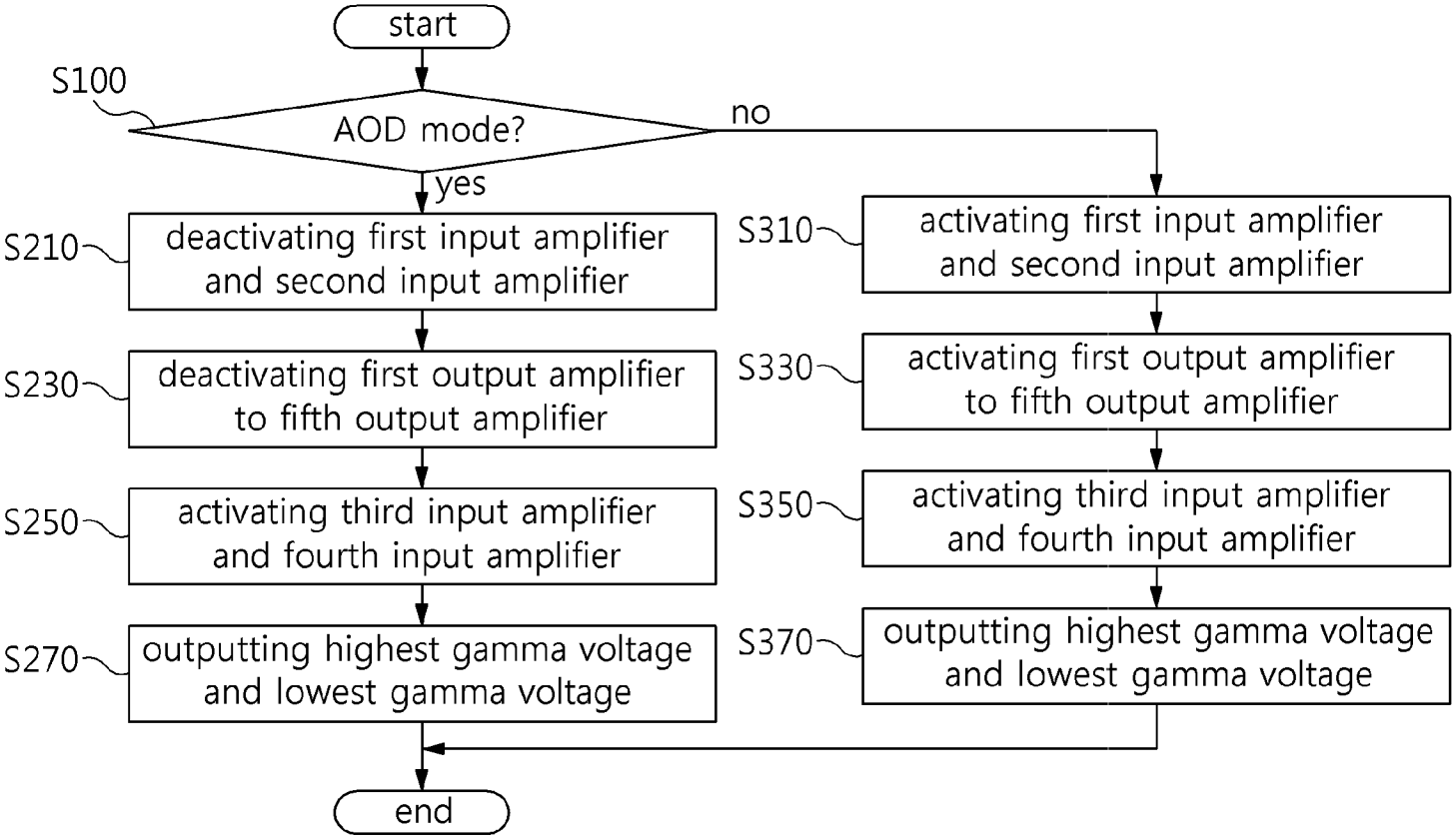
FIG. 5 is a view of a flowchart showing an exemplary gamma correction method according to one or more embodiments of the present invention.

Hereinafter, a gamma correction method according to one or more embodiments of the present invention will be described in detail with reference to FIG. 5.

When the display driving device operates in an AOD mode (S100; YES), in step S210, the gamma correction circuit deactivates the first input amplifier 120 and the second input amplifier 140. In other words, when the user stops using a working system including the display device and/or finishes using the mobile device including the display, the display driving device operates in an AOD mode. When the display driving device operates in an AOD mode, the gamma correction circuit deactivates the first input amplifier 120 and the second input amplifier 140 to minimize power consumption. Accordingly, the gamma correction circuit may prevent wasting power due to static current consumed by the first input amplifier 120 and the second input amplifier 140.

Herein, as the first input amplifier 120 and the second input amplifier 140 are deactivated, a voltage is not applied to the first resistor column 200 and the second resistor column 500 even though a first reference voltage and a second reference voltage are input. Accordingly, the gamma correction circuit may prevent wasting power, as the current I1 of the first resistor column 200 and the currents (e.g., I2+I3+I4+I5+I6+I7) of the second resistor column 500 are not formed (e.g., are zero or substantially zero).

In step S230, the gamma correction circuit also deactivates the first output amplifier 410 to the fifth output amplifier 490. In other words, when the display driving device operates in an AOD mode, the gamma correction circuit deactivates the first output amplifier 410 to the fifth output amplifier 490 to minimize power consumption. Accordingly, the gamma correction circuit may prevent wasting power due to the static current consumed by the first output amplifier 410 to the fifth output amplifier 490.

In step S250, the gamma correction circuit activates the third input amplifier 160 and the fourth input amplifier 180. In other words, when the display driving device operates in an AOD mode, only the highest gamma voltage and the lowest gamma voltage are needed. Accordingly, the gamma correction circuit activates the third input amplifier 160 and the fourth input amplifier 180.

In step S270, the gamma correction circuit outputs the highest gamma voltage and the lowest gamma voltage. In other words, when the first reference voltage is input to the gamma correction circuit, the third input amplifier 160 outputs the highest gamma voltage. When the second reference voltage is input to the gamma correction circuit, the fourth input amplifier 180 outputs the lowest gamma voltage.

Meanwhile, when the display driving device operates in a mode other than an AOD mode (S100; NO), in step S310, the gamma correction circuit activates the first input amplifier 120 and the second input amplifier 140.

In other words, the display driving device operates in a mode other than the AOD mode as the user starts using the mobile device. When the display driving device operates in a mode other than the AOD mode, the gamma correction circuit activates the first input amplifier 120 and the second input amplifier 140.

In step S330, the gamma correction circuit activates the first output amplifier 410 to the fifth output amplifier 490. Accordingly, the first output amplifier 410 to the fifth output amplifier 49 respectively output gamma voltages within a range from the highest gamma voltage V0 to the lowest gamma voltage V63. Voltages from the first output amplifier 410 to the fifth output amplifier 490 are applied to the second resistor column 500.

In step S350, the gamma correction circuit activates the third input amplifier 160 and the fourth input amplifier 180. In other words, the gamma correction circuit activates the third input amplifier 160 and the fourth input amplifier 180 to output the highest gamma voltage and the lowest gamma voltage.

In step S370, the gamma correction circuit may output the highest gamma voltage, the lowest gamma voltage, the maximum voltage, and the minimum voltage. In other words, when the first reference voltage and the second reference voltage are input, the gamma correction circuit may output the highest gamma voltage, the lowest gamma voltage, the maximum voltage, and the minimum voltage. In other words, when the first reference voltage is input, the first input amplifier 120 outputs the maximum voltage to the first resistor column 200 and the second resistor column 500, and the third input amplifier 160 outputs the highest gamma voltage. When the second reference voltage is input, the second input amplifier 140 outputs the minimum voltage to the first resistor column 200 and the second resistor column 500, and the fourth input amplifier 180 outputs the lowest gamma voltage.

As described above, when the display driving device operates in an AOD mode, the gamma correction circuit and the gamma correction method deactivate the first input amplifier, the second input amplifier, and the first output amplifier to the fifth output amplifier, and output the highest gamma voltage and the lowest gamma voltage by activating the third input amplifier and the fourth input amplifier. Accordingly, wasting power due to (i) the static current of the first and second input amplifiers and the first to fifth output amplifiers and (ii) power consumption of the first and second resistor column currents may be prevented.

In addition, the gamma correction circuit and the gamma correction method minimize power consumption by adding the third input amplifier and the fourth input amplifier. Thus, a low power AOD mode may be realized, while minimizing any increase in layout size relative to a conventional gamma correction circuit.

In addition, the gamma correction circuit the gamma correction method may increase static amplifier current due the an additional amplifiers relative to the conventional gamma correction circuit, but current flow in the first resistor column and the second resistor column is completely or substantially completely blocked, so that a low power AOD mode may be realized.

Although various embodiments of the present invention has been described for illustrative purposes, those skilled in the art will appreciate that other various modifications, additions and substitutions are possible, without departing from the scope and spirit of the invention as disclosed in the accompanying claims.

What is claimed is:

1. A gamma correction circuit, comprising:

a first input amplifier configured to output a maximum voltage when receiving a first reference voltage;

a second input amplifier configured to output a minimum voltage when receiving a second reference voltage;

a third input amplifier configured to output a highest gamma voltage when receiving the first reference voltage, wherein the first and third input amplifiers share a first input terminal; and a fourth input amplifier configured to output a lowest gamma voltage when receiving the second reference voltage, wherein the second and fourth input amplifiers share a second input terminal, wherein the first input amplifier and the second input amplifier are deactivated when the display driving device operates in an always on display (AOD) mode.

2. The circuit of claim 1, further comprising a first resistor column configured to receive the maximum voltage from the first input amplifier and the minimum voltage from second input amplifier, wherein the first resistor column distributes the maximum voltage and the minimum voltage, and the circuit further comprises a decoder configured to output a voltage from voltages distributed by the first resistor column.

3. The circuit of claim 2, further comprising an output amplifier configured to receive the voltage from the decoder.

4. The circuit of claim 3, wherein the output amplifier includes a first output amplifier to a fifth output amplifier, wherein the first output amplifier to the fifth output amplifier output gamma voltages that (i) exceed or are higher than the lowest gamma voltage, (ii) are less than the highest gamma voltage, and (iii) differ from each other.

5. The circuit of claim 3, wherein the output amplifier is deactivated when the display driving device operates in the AOD mode.

6. The circuit of claim 3, further comprising a second resistor column configured to receive a gamma voltage from the output amplifier.

7. The circuit of claim 6, wherein the second resistor column generates a grayscale voltage based on or in response to the gamma voltage, and output terminals of the third input amplifier and the fourth input amplifier are not electrically connected to the first resistor column and the second resistor column.

8. The circuit of claim 1, wherein the first input amplifier stops outputting the maximum voltage when the first input amplifier is deactivated, the second input amplifier stops outputting the minimum voltage when the second input amplifier is deactivated, the maximum voltage and the highest gamma voltage are the same, and the minimum voltage and the lowest gamma voltage are the same.

9. A gamma correction circuit, comprising:

a first input amplifier and a third input amplifier configured to receive a first reference voltage;

a second input amplifier and a fourth input amplifier configured to receive a second reference voltage;

a first resistor column configured to receive and distribute voltages from the first input amplifier and the second input amplifier;

a decoder configured to output one or more of the voltages distributed by the first resistor column;

a plurality of output amplifiers configured to receive the one or more voltages from the decoder, and output voltages that exceed or are higher than a voltage from the fourth input amplifier and less than a voltage from the third input amplifier; and a second resistor column configured to generate grayscale voltages based on or in response to the voltages from the plurality of output amplifiers, wherein output terminals of the third input amplifier and the fourth input amplifier are not electrically connected to the first resistor column or the second resistor column, and the first input amplifier, the second input amplifier, and the plurality of output amplifiers are deactivated when the display driving device operates in an always on display (AOD) mode.

10. The circuit of claim 9, wherein the first input amplifier outputs a maximum voltage to the first resistor column and the second resistor column when the first input amplifier is active, and the second input amplifier outputs a minimum voltage to the first resistor column and the second resistor column when the second input amplifier is active.

11. The circuit of claim 9, wherein the third input amplifier outputs a highest gamma voltage when the first reference voltage is input, and the fourth input amplifier outputs a lowest gamma voltage when the second reference voltage is input.

12. The circuit of claim 9, wherein the plurality of output amplifiers includes a first output amplifier to a fifth output amplifier, and the first output amplifier to the fifth output amplifier output gamma voltages that exceed or are higher than a voltage from the fourth input amplifier and are less than a voltage from the third input amplifier.

13. A gamma correction method for providing a gamma voltage output to a display driving device from a gamma correction circuit, the method comprising:

deactivating a first input amplifier and a second input amplifier of the gamma correction circuit when the display driving device operates in an always on display (AOD) mode;

deactivating a first output amplifier to a fifth output amplifier of the gamma correction circuit when the display driving device operates in the AOD mode; and outputting a highest gamma voltage and a lowest gamma voltage from a third input amplifier and a fourth input amplifier of the gamma correction circuit when the driving device operates in the AOD mode.

14. The method of claim 13, wherein outputting the highest gamma voltage and the lowest gamma voltage includes:

outputting the highest gamma voltage from the third input amplifier when a first reference voltage is input; and outputting the lowest gamma voltage from the fourth input amplifier when a second reference voltage is input.

15. The method of claim 13, wherein when the display driving device operates in a mode other than the AOD mode, the method further comprises:

activating the first input amplifier and the second input amplifier of the gamma correction circuit; and activating the first output amplifier to the fifth output amplifier of the gamma correction circuit.

16. The method of claim 15, wherein when the display driving device operates in the mode other than the AOD mode, the method further comprises:

outputting a maximum voltage from the first input amplifier; and outputting a minimum voltage from the second input amplifier, and the maximum voltage and the highest gamma voltage are the same, and the minimum voltage and the lowest gamma voltage are the same.

17. The method of claim 16, wherein outputting the maximum voltage comprises providing the maximum voltage to a first resistor column and a second resistor column, and outputting the minimum voltage comprises providing the minimum voltage output to the first resistor column and the second resistor column.

18. The method of claim 17, wherein when the display driving device operates in the mode other than the AOD mode, the method further comprises:

distributing the maximum voltage and the minimum voltage in the first resistor column; and outputting from a decoder a voltage from the distributed voltages.

19. The method of claim 18, wherein when the display driving device operates in the mode other than the AOD mode, the method further comprises:

receiving the voltage from the decoder by a plurality of output amplifiers; and outputting gamma voltages from the plurality of output amplifiers that are higher than or exceed the lowest gamma voltage and are less than the highest gamma voltage, and the gamma voltages differ from each other.

20. The method of claim 19, wherein when the display driving device operates in the mode other than the AOD mode, the method further comprises:

generating grayscale voltages in the second resistor column based on or in response to the gamma voltages from the plurality of output amplifiers; and outputting the grayscale voltages from the second resistor column.

* * * * *